US009873142B2

(12) United States Patent
Bjorge

(10) Patent No.: US 9,873,142 B2
(45) Date of Patent: Jan. 23, 2018

(54) COLD PLANER EXHAUST SYSTEM WITH ACCESS DOORS

(71) Applicant: CATERPILLAR PAVING PRODUCTS INC., Brooklyn Park, MN (US)

(72) Inventor: Jason Bjorge, Blaine, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/703,404

(22) Filed: May 4, 2015

(65) Prior Publication Data

US 2016/0326870 A1 Nov. 10, 2016

(51) Int. Cl.

| | |
|---|---|
| ***E01C 23/088*** | (2006.01) |
| ***E01C 23/12*** | (2006.01) |
| ***E21C 35/22*** | (2006.01) |
| ***B08B 9/04*** | (2006.01) |
| ***B08B 15/02*** | (2006.01) |

(52) U.S. Cl.

CPC ..... *B08B 9/04* (2013.01); *B08B 15/02* (2013.01); *E01C 23/088* (2013.01); *E01C 23/127* (2013.01); *E21C 35/223* (2013.01); *E01C 2301/50* (2013.01)

(58) Field of Classification Search

CPC .. E01C 2301/50; E01C 23/088; E01C 23/127; B28D 7/02; E21C 35/223

See application file for complete search history.

(56) References Cited

U.S. PATENT DOCUMENTS

| | | | | |
|---|---|---|---|---|
| 4,531,784 | A * | 7/1985 | Karlovsky | E21C 35/223 299/12 |
| 4,784,755 | A | 11/1988 | Taylor | |
| 5,021,149 | A | 6/1991 | Geisseler | |
| 5,518,299 | A * | 5/1996 | Adamczyk | E21F 5/20 299/12 |
| 5,597,393 | A * | 1/1997 | Johnson | E21C 35/223 299/64 |
| 6,733,086 | B1 | 5/2004 | McSharry et al. | |
| 7,175,364 | B2 | 2/2007 | Gaertner et al. | |
| 7,219,964 | B2 | 5/2007 | Berning et al. | |
| 2007/0122236 | A1 | 5/2007 | Gaertner et al. | |
| 2009/0267402 | A1 | 10/2009 | Berning et al. | |
| 2010/0327651 | A1 | 12/2010 | Cipriani | |
| 2011/0278907 | A1 | 11/2011 | Denson et al. | |
| 2014/0015303 | A1* | 1/2014 | Denson | E01C 23/088 299/39.2 |
| 2014/0232171 | A1* | 8/2014 | Willison | E21F 5/20 299/64 |

FOREIGN PATENT DOCUMENTS

EP 2910732 A1 * 8/2015

* cited by examiner

*Primary Examiner* — David J Bagnell
*Assistant Examiner* — Michael A Goodwin

(57) ABSTRACT

Cold planer exhaust systems and methods of clearing the same are disclosed. The exhaust systems and methods may include an inlet manifold located proximate a milling drum housing and above a material conveyor. The inlet manifold may further include at least one inlet passage and at least one access door configured to open and allow access to an interior of the exhaust system. The systems and methods may further include a ventilator configured to draw dust and fumes into and through the exhaust system.

18 Claims, 5 Drawing Sheets

COLD PLANER EXHAUST SYSTEM WITH ACCESS DOORS

TECHNICAL FIELD

The present disclosure generally relates to a cold planer and, more particularly, to a cold planer having an exhaust system adapted with access doors.

BACKGROUND

Asphalt-surfaced roadways have been built to facilitate vehicular travel. Depending upon usage density, base conditions, temperature variation, moisture variation, and/or physical age, the surface of the roadways can eventually become misshapen, non-planar, unable to support wheel loads, or otherwise unsuitable for vehicular traffic. In order to rehabilitate the roadways for continued vehicular use, spent asphalt is removed in preparation for resurfacing.

Cold planers, sometimes also called road mills or scarifiers, are machines that typically include a frame quadrilaterally supported by tracked or wheeled drive units. The frame supports an engine, an operator's station, and a milling drum. The milling drum, fitted with cutting tools, is rotated through a suitable interface by the engine to break up the surface of the roadway. Thereafter, the milled roadway may be delivered to one or more conveyors of the cold planer that ultimately deliver the milled roadway to a transport vehicle for removal from the worksite.

During the milling process, dust is produced by the cutting tools that may cause undesirable work conditions for the cold planer operator such as impaired visibility. In addition, bituminous vapors may be produced due to high temperature friction of the cutting tools. One attempt to control the dust and vapors produced during roadway milling is disclosed in U.S. Pre-Grant Publication No. US 2014/0015303 (the '303 publication), published on Jan. 16, 2014, and submitted by Denson et al. In particular, the '303 publication discloses an attachable cold planer exhaust system having multiple inlets for receiving dust and fumes generated during the milling process. For example, '303 discloses an inlet manifold downstream of the milling drum and above a primary material conveyor, the inlet manifold including inlet extensions positioned downward from the inlet manifold and to the sides of the primary conveyer. Openings in the inlet extensions draw dust and fumes into the exhaust system from the newly milled asphalt disposed on the primary conveyor. In addition, '303 discloses additional secondary inlet hoses of an exhaust system disposed at the transition area proximate the primary conveyor discharge end and the secondary conveyor charge end. As additional fumes and dust are generated in this transition area, secondary inlet hoses draw such fumes and dust into the exhaust system for delivery downstream to the secondary conveyor housing.

Although the systems of the '303 publication are helpful in controlling dust and fumes generated during the roadway milling process, these systems may still be problematic. For example, the '303 systems are subject to blockages within or clogging of the inlet openings, manifolds, tubes and hoses of the exhaust system. Specifically, in addition to the dust and fumes drawn into the exhaust system, pieces of asphalt or other material may also be inadvertently suctioned into the exhaust system. Such material may result in blockages at the main pickup area of the exhaust system, for example, within the inlet manifold, fittings, tubes or hoses of the exhaust system. Likewise, the continuous evacuation by the system of dust and vapors generated from the milling process of asphalt may result in build-up on the interior walls of the exhaust system inlet manifold, fittings, tubes and hoses. Such blockages and build-up may adversely affect the efficiency and performance of the exhaust system and may potentially damage the components the system, resulting in undesirable work conditions and an increased frequency of work machine maintenance. Moreover, cleaning of the '303 system may require the complete removal of the exhaust system from the cold planer and further disassembly thereof in order to clear its interior of any build-up and/or material blockages.

The cold planer and exhaust system and methods of the present disclosure attempt to overcome one or more of the disadvantages set forth above and/or other disadvantages in the art.

SUMMARY

In accordance with one aspect of the present disclosure, an exhaust system for a cold planer is disclosed which may include an inlet manifold located proximate a milling drum housing and above a material conveyor. The inlet manifold may include at least one inlet passage configured to receive dust and fumes generated by a milling drum, and at least one access door configured to open and allow access to an interior of the exhaust system. The exhaust system may further include a ventilator in fluid communication with the inlet manifold and the at least one inlet passage, the ventilator configured to draw the dust and fumes from the inlet manifold and the at least one inlet passage to the ventilator.

In accordance with another aspect of the present disclosure, a cold planer is disclosed which may include a frame, at least one traction device configured to support the frame, an engine supported by the frame and configured to drive the at least one traction device to propel the cold planer, a milling drum, and a material conveyor having a charge end located proximate the milling drum to receive removed material. The cold planer may further include an exhaust system having an inlet manifold located above a charge end of the first material conveyor, at least one inlet passage in the inlet manifold configured to receive dust and fumes generated by the milling drum, at least one access door in the inlet manifold configured to open and allow access to an interior of the exhaust system, and a ventilator in fluid communication with the inlet manifold and the at least one inlet passage. The cold planer disclosed may also include a material deflector supported on the frame and proximate the at least one inlet passage, the material deflector configured to block material from entering the at least on inlet passage.

In accordance with another aspect of the present disclosure, a method of cleaning out an exhaust system of a cold planer is disclosed which may include providing a cold planer having an exhaust system, the exhaust system including an inlet manifold configured to receive dust and fumes, the inlet manifold having at least one access door configured to open to allow access to an interior of the inlet manifold. The method of cleaning out an exhaust system of a cold planer may further include opening the at least one access door of the inlet manifold, and accessing an interior of the inlet manifold and clearing the inlet manifold of any material therein.

These and other aspects and features of the present disclosure will be better understood when read in conjunction with the accompanying drawings.

While the following detailed description will be given with respect to certain illustrative embodiments, it should be understood that the drawings are not necessarily to scale and the disclosed embodiments are sometimes illustrated diagrammatically and in partial views. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as any equivalents thereto.

DETAILED DESCRIPTION

For the purpose of this disclosure, the term "asphalt" may be defined as a mixture of aggregate and asphalt cement. Asphalt cement may be a brownish-black solid or semi-solid mixture of bitumens obtained as a byproduct of petroleum distillation. The asphalt cement may be heated and mixed with the aggregate for use in paving roadway surfaces, where the mixture hardens upon cooling. A "cold planer" may be defined as a machine used to remove layers of hardened asphalt from an existing roadway. It is contemplated that the disclosed cold planer and methods may also or alternatively be used to remove cement and other roadway surfaces.

Figure 1:
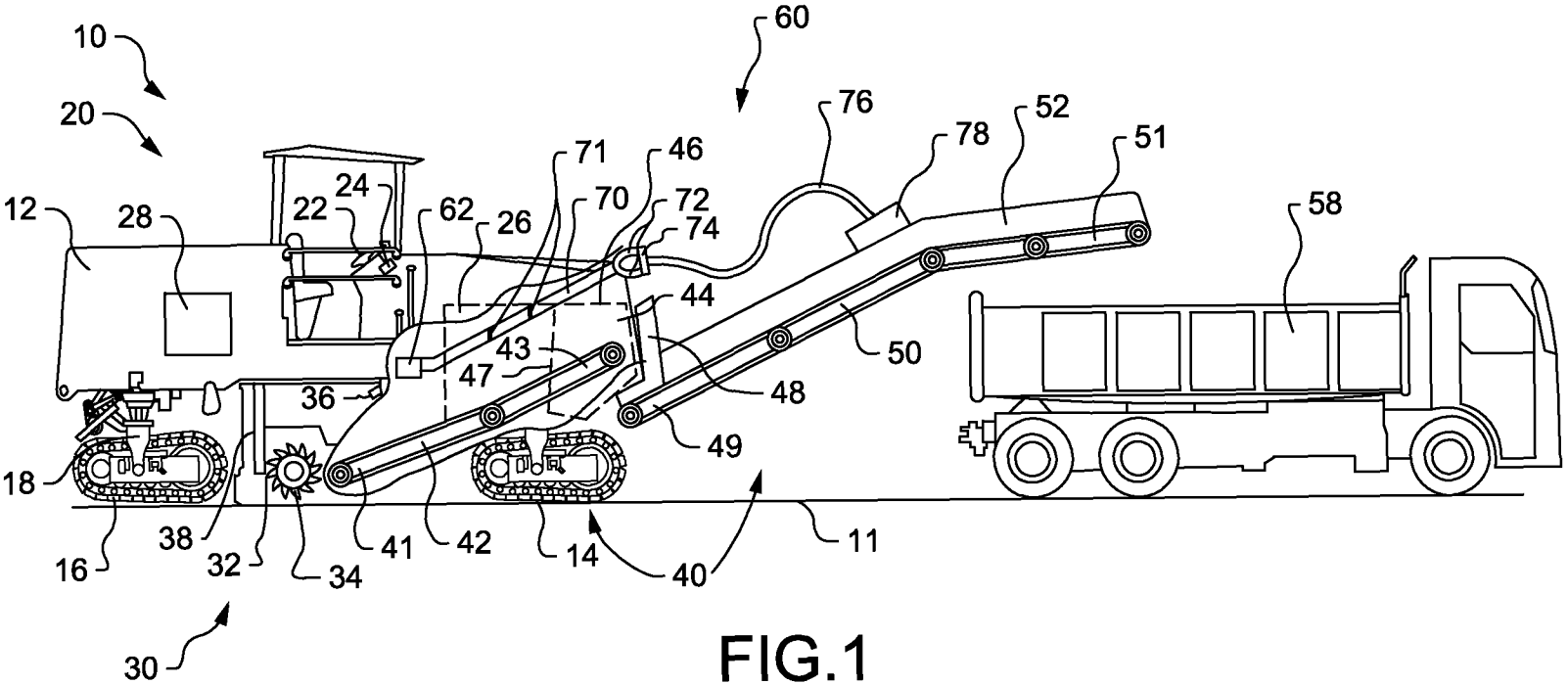
FIG. 1 is a side view of an exemplary cold planer machine, partly in section, showing an exemplary exhaust system.

FIG. 1 illustrates an exemplary cold planer 10 having a milling system 30 and a debris removal system 40. FIG. 1 also illustrates an exhaust system 60 that may be attachably integrated with the milling system 30 and the debris removal system 40 of the cold planer 10. It is contemplated that the exhaust system 60 may be integrated with additional components and systems within the cold planer 10, if desired, such as an auxiliary power system (not shown).

The cold planer 10 of FIG. 1 may include a frame 12 supported by one or more front ground engaging units 14 and one or more rear ground engaging units 16. The ground engaging units 14, 16 may each include either a wheel or a track section that is pivotable in one or more directions. The ground engaging units 14, 16 may be connected to lifting columns 18, which may be adapted to controllably raise and lower the frame 12 relative to the associated ground engaging units 14, 16.

The frame 12 may support an operator's station 20 having a steering command element 22 and a controller 24. The steering command element 22 is shown to include a steering wheel, but other steering devices such as a joystick or levers could be used as well. The controller 24 may send control signals to one or more actuators (not shown) of the following: ground engaging units 14, 16, lifting columns 18, milling system 30, debris removal system 40 and exhaust system 60. In the case of electrically activated actuators, the control signals may act directly on the respective actuators. In the case of hydraulically activated actuators, the control signals may act on valves, which in turn control flows of pressurized fluid to the actuators. The controller 24 may be a separate control unit or may be part of a central control unit operable to control additional functions of the cold planer 10.

The frame 12 may also support a water tank 26, an engine 28 such as an internal combustion engine, and the milling system 30. The engine 28 may supply power to drive one or more of the ground engaging units 14, 16 to propel the cold planer 10 relative to the road surface 11. In one embodiment, this is accomplished by driving a hydraulic pump with an output of the engine 28, which in turn supplies high-pressure hydraulic fluid to individual motors associated with the ground engaging units 14, 16. This conventional hydraulic drive is well-known in the pertinent art and is therefore not depicted in the drawings. The engine 28 may also supply power to the milling system 30 to break up the road surface 11.

The milling system 30 may include various components that interact to remove asphalt from the roadway surface 11. Specifically, the milling system 30 may include a milling drum 32, a plurality of cutting tools 34, a water nozzle 36 and a milling drum housing 38. The cutting tools 34 may be attached to the milling drum 32 in any manner known in the art. During the milling process, the cutting tools 34 may be frictionally heated on account of their sustained contact with the roadway surface 11. The water nozzle 36 may spray water on the milling drum 32 and its associated cutting tools 34 during the operation of the milling system 30 to cool the same. The milling system 30 may be configured to remove a layer of asphalt from the entire width of the roadway surface 11 or from only a portion of the roadway surface 11 at varying depths and contours. The broken-up road material may be carried away from the cold planer 10 by the debris removal system 40.

The debris removal system 40 may include various components that cooperate to remove milled asphalt from the milling system 30. Specifically, the debris removal system 40 may include a primary conveyor 42, a secondary conveyor 50, and a transition area 44 located between primary conveyor 42 and secondary conveyor 50. The cutting tools 34 may be configured to deliver milled asphalt onto a charge end 41 of the primary conveyor 42 as the milling drum 32 rotates towards the primary conveyor 42. As the milled asphalt exits a discharge end 43 of the primary conveyor 42, the milled asphalt may strike against a weldment 48 located within the transition area 44. The transition area 44 may be an enclosed box-like structure formed by a cover plate 46, and two or more side plates 47. Upon coming into forced contact with the weldment 48, the milled asphalt may break apart and fall onto a charge end 49 of the secondary conveyor 50. The milled asphalt, being transported by the secondary conveyor 50, may be kept from exiting the secondary conveyor 50 prematurely (i.e., kept from spilling off the sides) by a secondary conveyor housing 52. The secondary conveyor 50 may discharge the milled asphalt at a discharge end 51. The milled asphalt may be off-loaded to any appropriate transport vehicle 58, such as an on-highway haul truck, an off-highway articulated or non-articulated truck, or any other type of transport vehicle known in the art. In the disclosed embodiment, the secondary conveyor 50 may need to move somewhat relative to the primary conveyor 42. For example, the secondary conveyor 50 may need to move in side-to-side and/or up-and-down motions as it facilitates the discharge of milled asphalt to the moving transport vehicle 58.

During the milling process, dust may be produced on account of the breaking up of the road surface 11. In particular, relatively large quantities of dust may be produced at the milling drum 32, and when the milled asphalt is further broken down by coming into contact with the weldment 48 in the transition area 44. Bituminous vapors may also be produced due to high temperatures created by the friction of the cutting tools 34 against the road surface 11. The exhaust system 60 may be attachably integrated with the milling system 30 and the debris removal system 40 to help control the dust and fumes generated during operation of the cold planer 10.

Figure 2:
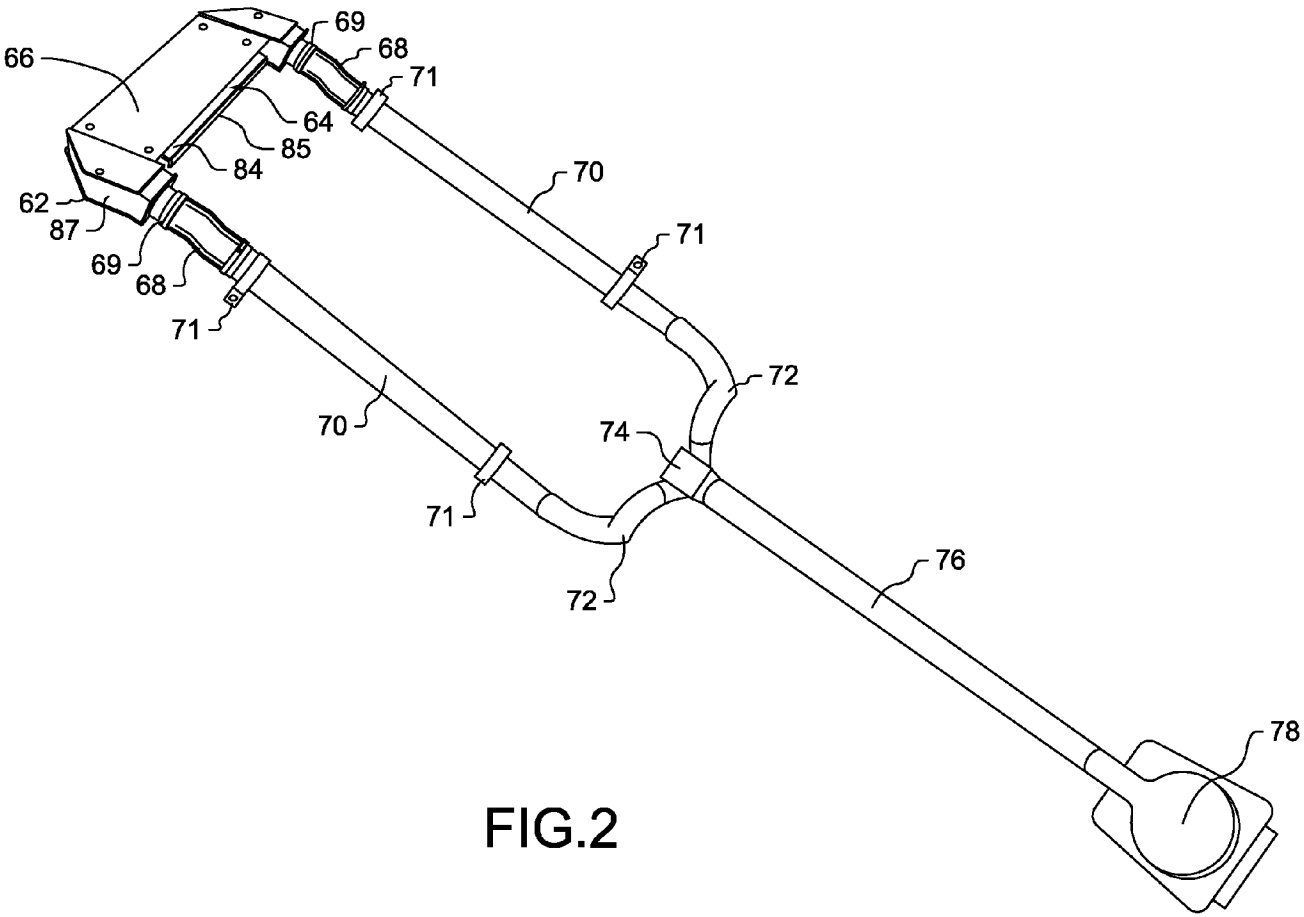
FIG. 2 is a perspective view of an exemplary exhaust system that may be used in conjunction with the cold planer of FIG. 1.

As illustrated in FIGS. 1 and 2, the exhaust system 60 may include various components that cooperate to remove dust and fumes during the operation of the cold planer 10. Specifically, the exhaust system 60 may include an inlet manifold 62. The inlet manifold 62 may be a generally U-shaped, elongated steel fabricated hood that includes an elongated inlet passage 64 through which dust and fumes are drawn into the exhaust system 60. Alternatively, the inlet manifold 62 may take any number of shapes that accommodate an inlet passage 64, including, but not limited to, rectangular, square, triangular or trapezoidal. A top side 66 of the inlet manifold 62 may be removably secured to the cold planer frame 12 by any number of various bolts, fasteners, clamps, joints, links, couplings or other mechanical attachment mechanisms. The inlet manifold 62 may be secured to the cold planer frame 12 proximate an exit area of the milling drum housing 38 where newly milled material is thrown up by the cutting tools 34 of the milling drum 32 and deposited onto the primary conveyor 42. In one exemplary embodiment, the inlet manifold 62 may be placed proximate the milling drum 32 and above the primary conveyor 42. In another exemplary embodiment, the inlet manifold 62 may be placed at about 300-800 mm downstream of the milling drum 32 so as to avoid drawing in larger fragments of milled material thrown into the air by the cutting tools 34. Dust and fumes generated by the milling system 30 may be routed into the inlet passage 64 of the inlet manifold 62 via suction produced by a ventilator 78.

Dust and fumes collected at the inlet manifold 62 may be evacuated or drawn through an arrangement of pipes and flexible tubes and/or hoses to the ventilator 78, where the collected dust and fumes may be delivered to the secondary conveyor 50 within the secondary conveyor housing 52. As illustrated in FIG. 2, evacuation passage or arrangement of pipes and flexible tubes of the exhaust system 60 may include, among other things, a plurality of flexible fittings 68, a plurality of rigid pipes 70, first and second flexible hoses 72 and 76, and a junction 74. For example, the inlet manifold 62 may be adapted to receive one or more flexible fittings 68. Such flexible fittings 68 may be received on any walls of the inlet manifold 62, for example, at opposite ends of the inlet manifold 62. The flexible fittings 68 may be fabricated from an elastomer, for example rubber, and connected (via connectors 69) at one end to the inlet manifold 62 and at an opposing end to the rigid pipes 70. The rigid pipes 70 may be connected to the flexible hoses 72 and run generally parallel to the primary conveyor 42 with one rigid pipe 70 located at each side of the water tank 26. The junction 74 may receive the combined air flow of the flexible hoses 72 and route the same to the flexible hose 76. In one exemplary embodiment, the rubber fittings 68, connections 69, rigid pipes 70 and flexible hoses 72 may be between about 3-5 inches in diameter, and the flexible hose 76 may be between about 7-9 inches in diameter. The flexible hose 76 may connect the junction 74 to the ventilator 78. Certain components of the exhaust system 60 (e.g., flexible fittings 68, flexible hoses 72 and flexible hoses 76) may need to be flexible so as to be able to move with the up-and-down and side-to-side motions of the secondary conveyor 50.

The ventilator 78 may create a depression within the exhaust system 60, such that the air pressure outside of the inlet manifold 62 is greater than the air pressure within the exhaust system 60. Consequently, dust and polluted air generated from the operation of the milling system 30 may be drawn in and routed through the exhaust system 60 to the secondary conveyor 50 within the secondary conveyor housing 52. In one embodiment, the ventilator 78 may be mounted on the secondary conveyor housing 52 and may include a cast aluminum fan wheel disposed within a steel fan housing, which may be powered by a hydraulic motor (not shown).

In one exemplary embodiment, the exhaust system 60 may be removably attached to the cold planer 10 at one or more attachment points 71, as shown in FIG. 1. The attachment points 71 may include any number of various rigid, elastic or plastic types of fasteners, clamps, joints, links, couplings or other mechanical attachment mechanisms. In one exemplary embodiment, the attachments 71 may connect the rigid pipes 70 to the water tank 26 and the ventilator 78 to the secondary conveyor housing 52. As the rigid pipes 70 may be removably attached to the exterior of the water tank 26, as opposed to running through the water tank 26, the exhaust system 60 may be easily removed from the cold planer 10. Upon removal of the detachable exhaust system 60 from the cold planer 10, the insertion points of the exhaust system 60 (e.g. where the airway of the ventilator 78 may enter into the secondary conveyor housing 52) may be plugged by any number of various different types of plugs, caps, fillers, fittings or stoppers.

In addition to the elongated inlet passage 64, the inlet manifold 62 may be further adapted with one or more inlet extensions (not shown) having additional openings for drawing dust and fumes into the exhaust system 60. Such inlet extensions may extend downward from opposite ends of the inlet manifold 62 to the lateral sides of the primary conveyor 42. The inlet extensions may be positioned such that they are likely to draw in a desired amount of dust and fumes, but unlikely to draw in larger fragments of milled material.

Further, the exhaust system 60 may also include secondary inlet hoses 76 that may be associated with the transition area 44 proximate the primary conveyor 42 discharge end 43 and the secondary conveyor 50 charge end 49. Such secondary hoses 76 may be placed downstream of the milling drum 32 and proximate the weldment 48. Dust and fumes generated by the milling system 30 and at the weldment 48 may be routed to the inlet manifold 62 and to the secondary inlet hoses 76 via suction produced by the ventilator 78. An exhaust system adapted with such secondary hoses 76 may include additional flexible hoses and hose connectors. Any such secondary hoses 76 of the exhaust system 60 may be further adapted with a secondary inlet manifold 62 having a secondary inlet passage 64 and secondary access door 82 similar that of the inlet manifold 62 positioned above the primary conveyor 42 charge end 41. Dust and fumes collected at the inlet manifold 62 and at any inlet extensions or secondary inlet hoses 76, or manifold 62 associated therewith, may be drawn through an arrangement of pipes and flexible tubes and/or hoses to the ventilator 78, where the collected dust and fumes may be delivered to the secondary conveyor 50 within the secondary conveyor housing 52.

Figure 3:
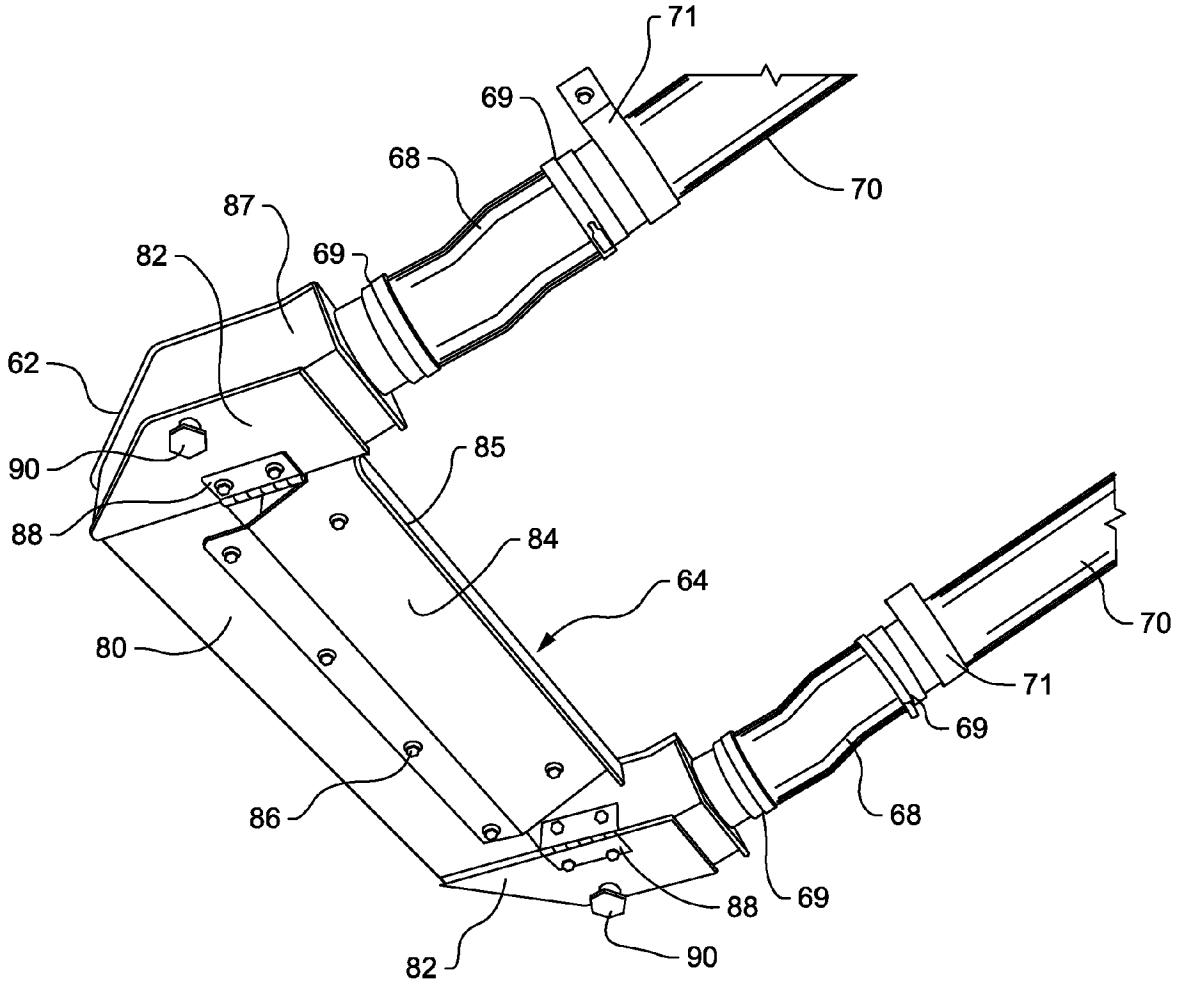
FIG. 3 is a bottom perspective view of an exemplary main pickup area of an exhaust system having access doors closed.
Figure 4:
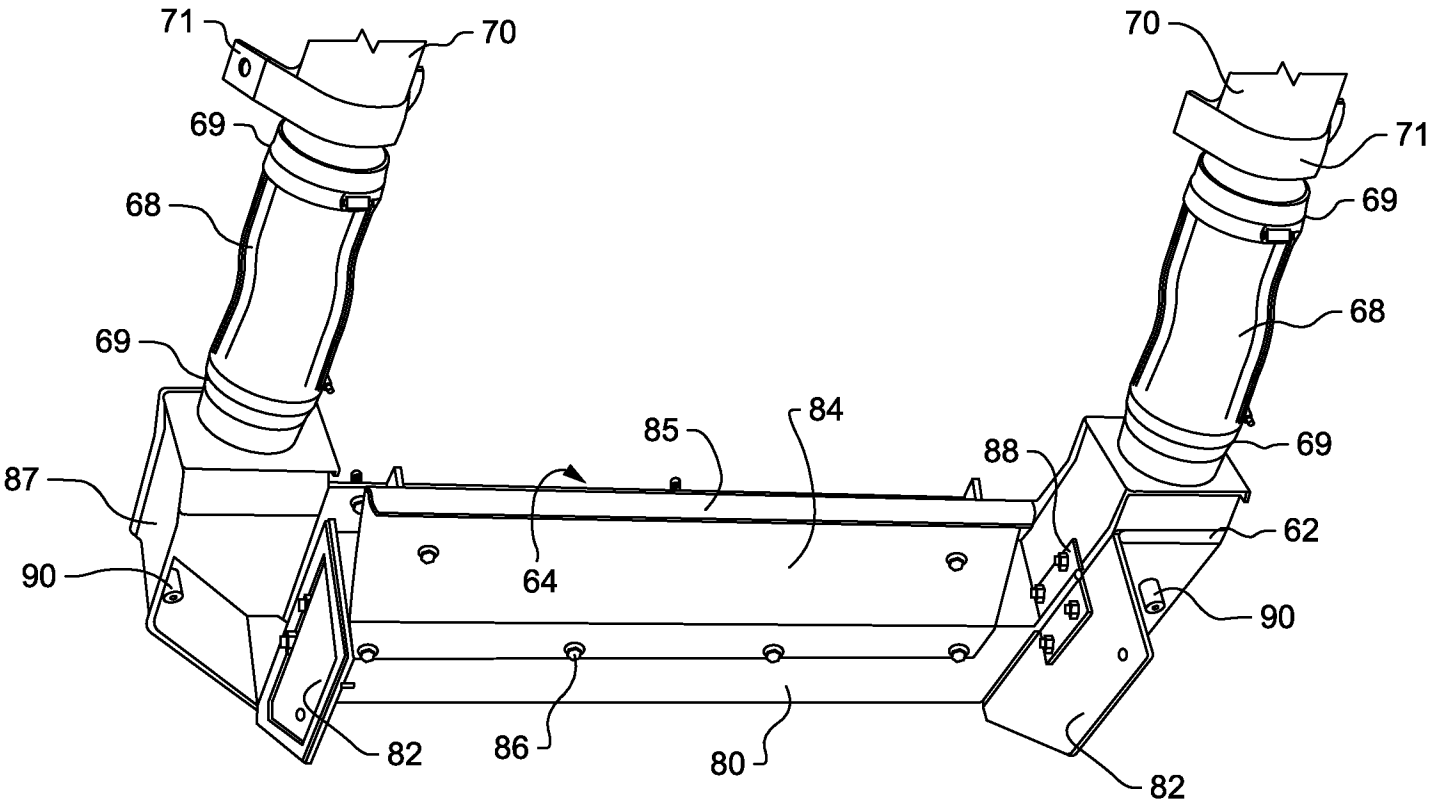
FIG. 4 is a bottom perspective view of an exemplary main pickup area of an exhaust system having access doors open.

The inlet manifold 62 of the exhaust system 60 may include an interior that is accessible for cleaning. Turning to FIGS. 3 and 4, a bottom side 80 of the inlet manifold 62 is illustrated, the bottom side 80 being adapted with access doors 82. Specifically, the bottom side 80 of the inlet manifold 62 may support a bottom inlet plate 84 that angles upwardly toward the top side 66 of the inlet manifold 62 (also illustrated in FIG. 5). The bottom inlet plate 84 may be removably secured to the bottom side 80 of the inlet manifold 62 using any number of various bolts, fasteners, clamps joints, links couplings or other mechanical attaching mechanisms 86. In operation, the exhaust system 60 may draw dust and fumes over a lip 85 of the bottom inlet plate 84 and into the elongated inlet passage 64 between the bottom inlet plate 84 and the top side 66 of the inlet manifold 62. Thereafter, dust and fumes may be routed out of the inlet manifold opposing ends and through the flexible fittings 68 and the rigid pipes 70.

Regular evacuation of dust and fumes at the main pickup area of the exhaust system 60 may result in a substantial amount of material build-up within the inlet manifold 62, as well as within the flexible fittings 68 and rigid pipes 70. Likewise, newly milled or other material may inadvertently be suctioned into the exhaust system 60, resulting in blockages within the inlet manifold 62, flexible fittings 68 and rigid pipes 70. The access doors 82 may open to allow access to and cleaning out of the inlet manifold 62, as well as its associated fittings 68 and pipes 70. Specifically, the bottom side 80 of the inlet manifold 62 may be adapted to include one or more access doors 82 that remain closed (FIG. 3) during operation of the exhaust system 60, but that may be opened (FIG. 4) in order to access the interior of the inlet manifold 62, fittings 68 and pipes 70 for cleaning or removing blockages. Such access doors 82 may be disposed anywhere on the bottom side 80 of the inlet manifold 62 or elsewhere on the inlet manifold 62, such as the inlet manifold side walls 87. Additionally, as shown in FIGS. 3 and 4, the access doors 82 may also be disposed at opposing ends of the inlet manifold 62 proximate the flexible fittings 68, thereby allowing easy access into the different components of the exhaust system 60.

The access doors 82 may be hingedly attached 88 to the bottom side 80 of the inlet manifold 62. The access doors 82 may further include a releasable locking mechanism 90, such as the nut and bolt arrangement illustrated in FIGS. 3 and 4, to secure the access doors 82 in a closed position during operation of the exhaust system 60. The locking mechanism 90 may however be any number of various mechanical mechanisms for maintaining the access doors 82 in a closed position, including fasteners, clamps, or a frictional fit between the access doors 82 and the inlet manifold 62. Manual release or opening of the locking mechanism 90 may in turn allow opening of the access doors 82 and access to the interior of the main pickup area of the exhaust system 60. While the access doors 82 are illustrated in FIGS. 3 and 4 as plates hingedly attached to the bottom side 80 of the inlet manifold 62, the access doors 82 may be in any shape or configuration that allows access to the interior of the exhaust system 60. For example, the access door may be a slidable plate within a track-type arrangement in the bottom side 80 of the inlet manifold 62, or elsewhere on the inlet manifold 62. Likewise, the access door may be a flexible, rolling-type door disposed in the inlet manifold 62. In addition, the access door arrangement may comprise a combination of any of the above described doors, such as a combination of a sliding plate that is accessible after the opening of a hinged access door. In addition, the access doors 82 may be transparent in nature. As such, the machine operator or other personnel may have a view into the inlet manifold 62 to observe build up and/or blockages in the exhaust system 60. In any case, the access doors 82 may be opened to allow access to an interior of the inlet manifold 62 as well as the flexible fittings 68 and rigid pipes 70.

Figure 5:
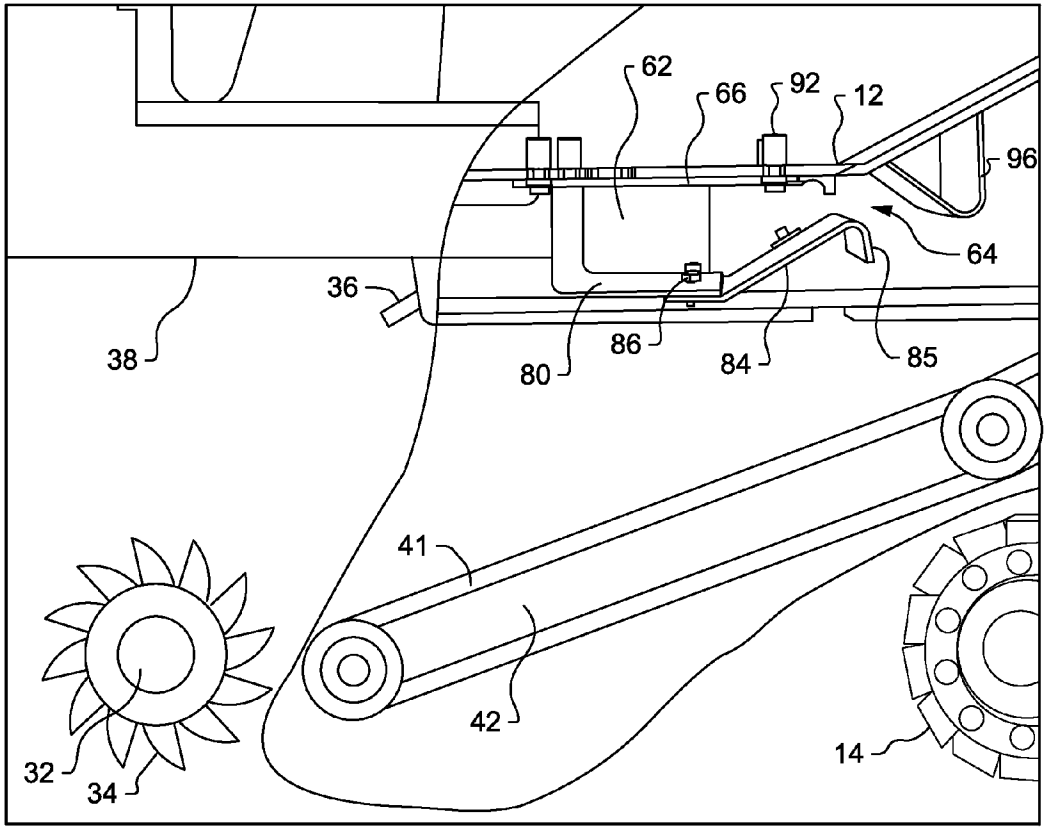
FIG. 5 is an enlarged side view of an exemplary cold planer machine, partly in section, showing an exemplary exhaust system inlet manifold and material deflector.

FIG. 5 illustrates the mounting of the inlet manifold 62 to the underside of the frame 12 of the cold planer 10. The top side 66 of the inlet manifold 62 may be removably secured to the frame 12 by any number of various mechanical attachment mechanisms 92, such as a nut and bolt arrangement. As illustrated in FIG. 5, the inlet manifold 62 may be secured to the cold planer frame 12 proximate an exit area of the milling drum housing 38 where newly milled material is directed upwardly by the cutting tools 34 of the milling drum 32 and deposited onto the charge end 41 of the primary conveyor 42. In one exemplary embodiment, the inlet manifold 62 may be placed proximate the milling drum 32 and above the primary conveyor 42. As such, when the ventilator 78 creates a depression within the exhaust system 60, dust and fumes generated by the milling system 30 may be drawn over the lip 85 of the bottom inlet plate 84 and into the inlet passage 64 of the inlet manifold 62.

The material or debris removal system 40, including the primary conveyor 42, may, in certain instances during operation of the cold planer 10, be required to operate in a reverse direction. For example, newly milled material is carried by the primary conveyor 42 for delivery to the secondary conveyor 50, and ultimately to the transport vehicle 58. Should a material blockage occur in the transition area 44 between the primary conveyor 42 and the secondary conveyor 50, the operator of the cold planer 10 may be obliged to reverse the forward movement of the primary conveyor 42 to thereby release any possible blockage being created by "backed-up" milled material. Reverse movement of the primary conveyor 42 may inadvertently result in milled material entering the exhaust system 60 through the inlet passage 64 of inlet manifold 62. Such an undesirable result may adversely affect the efficiency of the exhaust system 60 or shut it down completely.

In order to avoid any such reception of milled material into the inlet passage 64 of the inlet manifold 62, the frame 12 may be adapted with a material deflector 96. The material deflector 96 may extend downwardly from an underside of the frame 12 and may be disposed adjacent the bottom inlet plate 84 and lip 85 of the inlet manifold 62. As illustrated in FIG. 5, the material deflector 96 may be generally triangular and partially gravitationally higher than the inlet manifold 62. In addition, the material deflector 96 may be equal or the same general length as that of the inlet passage 64. For example, where the inlet passage 64 is an elongated slot between the bottom inlet plate 84 and top side 66 (illustrated in FIGS. 2-4), the material deflector 96 may also be an elongated structure extending down from the frame 12 and positioned between opposite ends of the inlet manifold 62 or between the flexible fittings 68 and/or rigid pipes 70. In such a configuration, the material deflector 96 may deflect entry of unwanted material anywhere along the length of the inlet passage 64 of inlet manifold 62. However, the material deflector 96 may be of any size or shape that prevents entry of milled material or other items into the inlet manifold 62 while leaving the inlet passage 64 for dust and fumes uninterrupted.

Also contemplated in the present disclosure is a method of cleaning out the exhaust system 60 of the cold planer 10.

With reference to the drawings generally, the method for cleaning out the exhaust system 60 may include a first step of providing a cold planer 10 having an exhaust system 60, the exhaust system 60 comprising an inlet manifold 62 having at least one access door 82 configured for opening to allow access to an interior of the inlet manifold 62, as well as additional elements in the main pickup area of the exhaust system 60. The method of cleaning out the exhaust system 60 may further include the step of opening the access door 82, thereby exposing the interior of the inlet manifold 62. Thereafter, the method may include the step of accessing an interior of the inlet manifold and clearing away material build-up therein or any material blockages.

As described above, the access doors 82 of the inlet manifold 62 may swing or slide open to allow access to the interior of the inlet manifold 62. The step of opening the access doors may include unlocking the access doors 82 by unfastening or releasing the mechanical attachment employed to secure the access doors 82 in a closed position during operation of the exhaust system 60. For example, this step may include loosening a nut/bolt arrangement 90 like that depicted in FIG. 3. When opening the access doors 82, material built up within the inlet manifold 62 or material creating a blockage in the inlet manifold 62 may simply fall out gravitationally. Once the access doors 82 are open, the step of accessing and clearing out the interior of the inlet manifold 62 may further include the operator or other personnel inserting any number of various tools into the inlet manifold 62 to clear away build-up or dislodge material within the inlet manifold 62, flexible fittings 68 or rigid pipes 70. For example, in order to clear away build-up or material, an operator or other personnel may manually clean out this main pickup area of the exhaust system 60 using a brush, chisel, wedge, blade, driver, tongs, vacuum, or any other tool that facilitates cleaning of the exhaust system 60. Such tools may include flexible portions allowing manipulation of their direction within the exhaust system 60, thereby allowing access to different components of the exhaust system 60. In certain instances, where the inlet manifold 62 is adapted with more than one access door 82, an operator or other personnel may insert a tool through one access door 82 and thereafter push any material dislodged or cleared away through the inlet manifold 62 and out of the additional opened access door 82. This disclosed method of cleaning out the exhaust system 60 may be performed routinely or whenever necessitated, at a worksite, without removal of the entire exhaust system 60 from the cold planer 10.

While the above detailed description and drawings are made with reference to a cold planer used in road rehabilitation, it is important to note that the teachings of this disclosure can be employed on other machines and methods used in construction, agriculture and industrial environments, or any other applications where cold planers or the like may be employed.

INDUSTRIAL APPLICABILITY

The disclosed exhaust systems and methods may be used with any road material or asphalt removal system where control of milling-generated dust and fumes is desired. Specifically, the disclosed exhaust systems may help to prevent the escape of dust and fumes from the cold planer 10 by routing the dust and fumes to the secondary conveyor 50, from which they can be off-loaded along with the milled asphalt at the secondary conveyor discharge end 51. In this manner, the working conditions for the cold planer operator and other personnel are improved.

Regular evacuation of dust and fumes by the exhaust system 60 may result in substantial build-up within the main pickup area of the exhaust system 60. Likewise, the suction created by the exhaust system 60 may be capable of inadvertently suctioning unwanted material into the exhaust system 60, including pieces of newly milled asphalt, thereby creating blockages within the main pickup area of the exhaust system 60. In order to avoid this undesirable result, the cold planer frame 12 may be adapted with a material deflector 96 disposed adjacent the inlet passage 64 of the inlet manifold 62 of the exhaust system 60. The operation of the exhaust system 60 as well as the cleaning out of the exhaust system 60 will now be explained.

As illustrated in FIG. 1, the cold planer 10 may break-up and remove asphalt with the milling drum 32. During the operation of the milling system 30, the water nozzle 36 may spray water from the water tank 26 onto the milling drum 32 so as to cool the milling drum 32 and its associated cutting tools 34. In addition to cooling the milling system 30, the sprayed water from the water nozzle 36 may also help control dust and fumes that may be generated as a byproduct of the milling process. The water may coalesce the dust particles and fumes with the milled material.

As the milling drum 32 rotates towards the primary conveyor 42, the cutting tools 34 may heap the wet milled asphalt onto the primary conveyor 42. The milled asphalt on the primary conveyor 42 may then be transported to and thrust against the weldment 48 of the transition area 44. As the milled asphalt strikes the weldment 48, it may break down further and fall onto the secondary conveyor 50. The secondary conveyor 50 may transport the milled material to the secondary conveyor discharge end 51, where the milled material may be off-loaded to the transport vehicle 58.

Although water distributed via the water nozzle 36 may help to control the amount of dust and fumes generated during the operation of the cold planer 10, a significant amount of dust and fumes may still result. In particular, the operation of the milling drum 32 and the crashing of the milled asphalt into the weldment 48 are two operations of the cold planer 10 that may result in significant amounts of dust and fumes despite the addition of water. The exhaust system 60 further assists in controlling the escape of dust and fumes generated during the operation of the cold planer 10. Likewise, the employment of a secondary exhaust system, having a pickup area proximate the transition area 44 may assist in preventing the escape of dust and fumes.

The ventilator 78 may create a depressed air pressure state within the exhaust system 60 such that polluted air may be drawn into the inlet manifold 62 and routed to the secondary conveyor housing 52. As described herein, the exhaust system 60 may also be adapted with inlet extensions and secondary inlet hoses, as well a secondary inlet manifold associated therewith, all of which are capable of contributing to the suctioning off and displacement dust and fumes generated by the cold planer 10. The secondary conveyor 50 may be housed by the secondary conveyor housing 52 in such a way so as to prevent the escape of collected dust and fumes prior to the discharge of the same along with the milled asphalt at the secondary conveyor discharge end 51. The length of the secondary conveyor 50 and the secondary conveyor housing 52 may provide ample time for the collected dust and fumes delivered by the ventilator 78 to settle and coalesce into the wet milled asphalt being transported on the secondary conveyor 50. Consequently, the dust and fumes collected by the exhaust system 60 may be discharged along with the milled asphalt material at the secondary conveyor discharge end 51.

With the disclosed placement of the inlet manifold 62 proximate the milling drum housing 38 and above the primary conveyor 42, it may be more likely that dust and fumes generated at the milling drum 32 are drawn into the inlet manifold 62 rather than significantly larger fragments of milled asphalt. If larger fragments of milled asphalt are drawn into the inlet manifold 62 and routed through the exhaust system 60, the ventilator 78 may incur significant damage. In certain instances, the cold planer operator may be obliged to reverse the direction of the primary conveyor 42, thereby increasing the chance that milled material will enter the inlet manifold 62. For example, the primary conveyer 42 movement may be reversed in order to release a material backup or blockage in the transition area 44. In order to prevent entry of newly milled material, or other material, during the reverse movement of the primary conveyor 42, or at any point during operation of the cold planer 10 and exhaust system 60, a material deflector 96 may be disposed on the cold planer frame 12 adjacent the inlet passage 64 of the inlet manifold 62. As such, any material suctioned or inadvertently directed from the primary conveyor 42 towards the inlet manifold 62 during operation of the cold planer 10 may be redirected by the material deflector 96 so as not to enter the inlet passage 64 and the inlet manifold 62. Prevention of such unwanted entry of material into the exhaust system 60 helps to avoid damage to the exhaust system 60 and the machine maintenance associated therewith.

The disclosed system and methods do, however, allow cleaning and clearing away or dislodging of any material build-up or blockages within the main pickup area of the exhaust system 60. Specifically, when necessary, an operator or other personnel, being provided with the cold planer 10, having an exhaust system 60 including an inlet manifold 62 with at least one access door 82 configured to open to allow access to an interior of the inlet manifold 62, may elect to clean out a main pick up area of the exhaust system when the cold planer is stationary and not operating. In order to clean or clear the inlet manifold 62 of any material therein, the operator may open the at least one access door 82 provided in the inlet manifold 62. Opening the access door 82 allows the operator access to an interior of the exhaust system 60, including the inlet manifold 62, flexible fittings 68 and rigid pipes 70. The access doors 82 may be adapted with a locking mechanism 90 that the operator is required to release before opening. Unlocking the access doors 82 for opening may be accomplished manually by unfastening or releasing whatever mechanical attachment is in place to secure the access doors 82 closed during operation of the exhaust system 60 and cold planer 10. Therefore, for regular cleaning of the exhaust system 60, or when material does inadvertently enter the inlet manifold 62 of the exhaust system 60, an operator or other personnel may access this area of the exhaust system 60 by unlocking and opening the access doors 82.

Once the operator or other personnel has gained access to the interior of the inlet manifold 62 through the access doors 82, material built up in the inlet manifold 62 or creating a blockage within the same may simply gravitationally fall out with the opening of the access doors 82. Otherwise, the operator may insert any number of tools into the inlet manifold 62 through the openings created by the access doors 82 to clean out or clear any blockages in this main pickup area. For example, one may insert a chisel or other wedge-like tool in order to break away build-up on an interior wall of the inlet manifold 62. Alternatively, a brush may be sufficient. The cleaning tools used may include flexible portions enabling the operator to manipulate the direction of the tool within this pickup area of the exhaust system 60 and therefore access and clean the flexible fittings 68 and rigid pipes 70. Likewise, one may employ tongs or a vacuum to further facilitate the cleaning out of this pickup area of the exhaust system 60. In addition, where multiple access doors 82 are present, one may insert a tool into the inlet manifold 62 through one access door 82 and thereafter push any broken away build-up or blocking material out of the inlet manifold 62 through the other opened access door 82. Where required, the operator may elect to remove the bottom inlet plate 84 from the inlet manifold 62 by releasing the attachment mechanisms 86. Such removal of the bottom inlet plate 84 may be required where build-up or blockages cannot be cleared through the opened access doors 82. The disclosed methods of cleaning out this main pickup area can be performed on site and manually by most any worker, either routinely or when necessitated. Moreover, removal from the cold planer 10 and disassembly of the exhaust system 60 is not required in the disclosed methods for cleaning the exhaust system 60.

The disclosed system and methods for preventing material from entering the exhaust system 60 and for cleaning out the exhaust system 60 may improve the overall efficiency of the exhaust system 60. In this manner, machine or exhaust system maintenance and repair may be less frequently required. In addition, the improved efficiency of dust and fume removal by the exhaust system 60 may significantly improve the working conditions for the cold planer operator and other personnel. Specifically, visibility at or near the operator station 20 may be improved. In this way, visibility of the road surface 11 at the point of milling may be more closely and accurately monitored. Therefore, in the context of road rehabilitation, the present disclosure offers a far more efficient system and method for dust and fume evacuation wherein the system may advantageously be manually cleaned out and improved on site.

The disclosed exhaust system 60 may be easily and removably attached to many different types and models of cold planers. As the rigid pipes 70 may be removably attached to the exterior of the water tank 26, as opposed to running through the water tank 26, the exhaust system 60 may be easily attached to or removed from the cold planer 10. Specifically, older machines may be retrofitted with the exhaust system 60 if the exhaust-related benefits of such are desired. Further, regulatory standards may require that an older or current model of the cold planer 10 be retrofitted with a system such the exhaust system 60.

All references to the disclosure or examples thereof are intended to reference the particular exhaust system or method being discussed at that point and are not intended to imply any limitation as to the scope of the disclosure more generally. Additionally, those skilled in the art will appreciate that various modifications might be made to the presently disclosed exhaust system and methods without departing from the full and fair scope of the present disclosure.

What is claimed is:

1. An exhaust system for a cold planer, comprising:

an inlet manifold located at an exit area of a milling drum housing, downstream, in a direction of travel of milled material, from a milling drum and above a material conveyor, the inlet manifold comprising:

a top side removably secured to a frame of the cold planer, a bottom side positioned below the top side when the top side is removably secured to the frame and including at least one access door configured to open and allow access to an interior of the exhaust system, and a bottom inlet plate supported by the bottom side and extending downstream, in a direction of travel of milled material, from the bottom side and angled upwardly toward the top side so that a distance between the top side and the bottom inlet plate decreases as the bottom inlet plate extends downstream, wherein the bottom inlet plate and the top side define at least one inlet passage at a downstream end of the inlet manifold configured to received dust and fumes generated by the milling drum; and a ventilator in fluid communication with the inlet manifold and the at least one inlet passage, the ventilator configured to draw the dust and fumes from the inlet manifold and the at least one inlet passage to the ventilator.

2. The exhaust system of claim 1, wherein the inlet passage is between a bottom side and a top side of the inlet manifold.

3. The exhaust system of claim 1, wherein the inlet passage is elongated and positioned between opposite ends of the inlet manifold.

4. The exhaust system of claim 1, wherein the at least one access door includes two access doors located at opposite ends of the inlet manifold.

5. The exhaust system of claim 1, wherein the at least one access door includes a manually releasable locking mechanism.

6. The exhaust system of claim 1, wherein the at least one access door is transparent.

7. The exhaust system of claim 1, further comprising at least one evacuation passage extending from the inlet manifold to the ventilator.

8. The exhaust system of claim 1, further comprising a secondary inlet manifold located between the inlet manifold and the ventilator, the secondary inlet manifold including at least one secondary inlet passage configured to receive dust and fumes, and at least one secondary access door in the secondary inlet manifold configured to open and allow access to an interior of the secondary inlet manifold.

9. A cold planer, comprising:

a frame;

at least one traction device configured to support the frame;

an engine supported by the frame and configured to drive the at least one traction device to propel the cold planer;

a milling drum;

a material conveyor having a charge end located to receive removed material delivered onto the charge end by the milling drum;

an exhaust system comprising:

an inlet manifold located above the charge end of the material conveyor and downstream, in a direction of travel of milled material, of the milling drum, the inlet manifold comprising:

a top side removably secured to the frame, a bottom side positioned below the top side when the top side is removably secured to the frame, and including at least one access door in the inlet manifold configured to open and allow access to an interior of the exhaust system, and a bottom inlet plate supported by the bottom side and extending downstream, in a direction of travel of milled material, from the bottom side and angled upwardly toward the top side so that a distance between the top side and the bottom inlet plate decreases as the bottom inlet plate extends downstream, wherein the bottom inlet plate and the top side define at least one inlet passage at a downstream end of the inlet manifold configured to received dust and fumes generated by the milling drum, and a ventilator in fluid communication with the inlet manifold and the at least one inlet passage; and a material deflector supported on the frame and adjacent the at least one inlet passage, the material deflector configured to block material from entering the at least on inlet passage.

10. The cold planer of claim 9, wherein the inlet passage is elongated and positioned between opposite ends of the inlet manifold.

11. The cold planer of claim 10, wherein the material deflector is elongated and has a length equal to a length of the inlet passage.

12. The cold planer of claim 9, wherein the at least one access door includes two access doors located at opposite ends of the inlet manifold.

13. The cold planer of claim 9, wherein the at least one access door includes a manually releasable locking mechanism.

14. The cold planer of claim 9, wherein the exhaust system is detachable from the cold planer.

15. The cold planer of claim 9, wherein the ventilator is mounted upon and configured to discharge into a conveyor housing.

16. The cold planer of claim 9, wherein the inlet manifold of the exhaust system is accessible for manual manipulation and cleaning.

17. A method of cleaning out an exhaust system of a cold planer, comprising:

providing a cold planer having an exhaust system, the exhaust system including an inlet manifold downstream, in a direction of travel of milled material, of a milling drum, above a primary material conveyor and configured to receive dust and fumes, the inlet manifold comprising:

a top side removably secured to a frame of the cold planer, a bottom side positioned below the top side when the top side is removably secured to the frame and having at least one access door configured to open to allow access to an interior of the exhaust system, and a bottom inlet plate supported by the bottom side and extending downstream, in a direction of travel of milled material, from the bottom side and angled upwardly toward the top side so that a distance between the top side and the bottom inlet plate decreases as the bottom inlet plate extends downstream, wherein the bottom inlet plate and the top side define at least one inlet passage at a downstream end of the inlet manifold configured to receive dust and fumes generated by a milling drum;

opening the at least one access door of the inlet manifold; and accessing an interior of the inlet manifold and clearing the inlet manifold of any material therein.

18. The method of claim 17, wherein opening the at least one access door requires unlocking the access door.

* * * * *